United States Patent [19]

Forbes, Jr. et al.

[11] 4,034,908

[45] July 12, 1977

[54] COMPARTMENTED DISPLAY CARTON

[75] Inventors: Hampton E. Forbes, Jr., Wilmington; John M. Nock, New Castle, both of Del.

[73] Assignee: Westvaco Corporation, New York, N.Y.

[21] Appl. No.: 706,609

[22] Filed: July 19, 1976

[51] Int. Cl.[2] ..... B65D 5/22; B65D 5/50

[52] U.S. Cl. ..... 229/34 HW; 229/31 FS; 206/814

[58] Field of Search ..... 229/34, 34 HW, 17 M; 206/814, 248, 242; 222/454, 455, 456, 457

[56] References Cited

U.S. PATENT DOCUMENTS

| | | | |
|---|---|---|---|
| 2,157,686 | 5/1939 | Ballard | 229/31 FS |
| 2,334,425 | 11/1943 | Lowey | 229/31 FS |
| 2,668,654 | 2/1954 | Freel et al. | 229/34 HW X |
| 2,750,082 | 6/1956 | Kowal | 222/455 |
| 2,783,929 | 3/1957 | Delaney | 229/34 HW X |
| 3,182,886 | 5/1965 | Persson | 229/34 HW |
| 3,298,576 | 1/1967 | Sellors | 222/456 |
| 3,804,321 | 4/1974 | Forbes, Jr. | 229/38 |

*Primary Examiner*—Davis T. Moorhead

[57] ABSTRACT

The compartmented display carton of the present invention is prepared from a one piece blank of paperboard or the like having a printability coating only on one surface. The blank is scored and cut to provide hollow end and side walls, an integral top and an interior divided into a plurality of compartments having different widths between the hollow side walls and different lengths between the hollow end walls, all interior and exterior panels having a printability surface.

1 Claim, 3 Drawing Figures

COMPARTMENTED DISPLAY CARTON

BACKGROUND OF INVENTION

The present invention relates to the field of packaging and display, and more particularly, it relates to an easily erectable carton having finished interior and exterior surfaces with an integral top, hollow side and end walls and an interior that is divided into a plurality of compartments having different widths and lengths between the hollow side and end walls.

Hollow walled cartons are well known in the art, as are cartons with completely finished surfaces. Moreover, cartons of this type are available that are easily erectable with a minimum number of gluing or folding steps. However, none of the known cartons of the general type herein disclosed are provided with an integral, finished two-side top, and none utilize a compartmented interior as disclosed herein.

Compartmented cartons are particularly useful for packaging different products having various shapes and sizes. In particular compartmented cartons with completely finished surfaces find especially good application for combination display purposes and carry out convenience. In this regard, the carton of the present invention was designed to package and for shipping a plurality of cigars of different shapes and sizes to replace the conventional fiberboard cigar boxes that previously required false inserts to accomodate different sized cigars. However, the carton of the present invention could just as readily be used to package and/or ship cosmetics, gourmet food products or notions. The completely finished inner and outer surfaces provide adequate space for printing graphics for such use, and the hollow walled construction provides more than adequate strength and protection for shipping through the mail.

DESCRIPTION OF THE PRIOR ART

The known hollow walled or double walled cartons of the prior art are believed to be represented by the following list of U.S. Pat. Nos. 2,157,686; 2,334,425; 2,444,497; 3,136,473.

Each of the cartons disclosed in the patents listed above feature ease of assembly, a minimum number of gluing and folding steps with a one-piece blank, and self locking corners as provided by the present invention. Moreover, the cartons disclosed in the above noted patents also achieve finished inner and outer surfaces with the coating applied to only one surface of the blank. However, the patented cartons are each of the open top tray type and none have a compartmented interior as compared with the closed carton of the present invention.

On the other hand, there are other cartons available of a dissimilar type which feature staggered interior walls substantially as disclosed in the following list of U.S. Pats. Nos. 3,156,351; 3,804,321.

However, a careful review of the patents listed immediately above will demonstrate that the intended use of the patented cartons and their overall construction are each substantially different from the carton disclosed herein. Thus it may be seen that the carton of the present invention fills the need for an inexpensive yet high quality package both for display, point-of-purchase carryout and for shipping a plurality of items having different sizes and/or shapes.

DETAILED DESCRIPTION

The carton of the present invention is prepared from a one-piece blank of paperboard or the like that is coated on one side with a printability coating. However, the blank is cut and scored so as to form a final carton configuration that has finished or printability interior and exterior surfces. Moreover, the carton blank is also cut and scored to provide an integral top, hollow side and end walls and an interior space that is divided into a plurality of compartments having different widths between the hollow side walls and different lengths between the hollow end walls.

Figure 1:
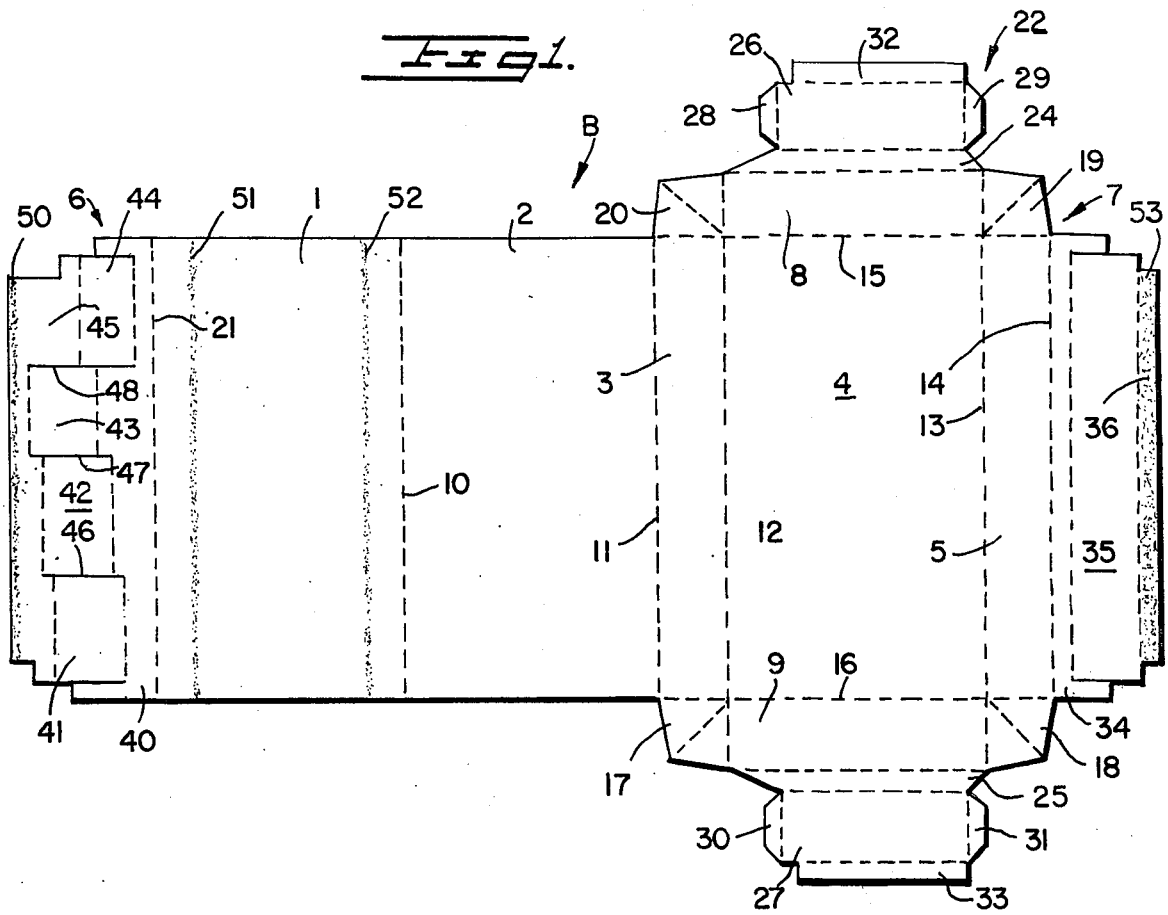
FIG. 1 is a plan view of a typical carton blank suitable for preparing the carton of the present invention.

In this regard, FIG. 1 shows a typical blank construction for use in fabricating the carton of the present invention. The blank of FIG. 1 is preferably arranged with the printability or coated side down and includes a pair of top cover panels 1,2 separated by fold line 10, a bottom panel 4, a first outer end wall 5 separated from the bottom panel along fold line 13 and a second outer end wall panel 3 separated from the top cover panel 2 by fold line 11 and from bottom panel 4 by fold line 12.

Attached to panels 1 and 5 along fold lines 21 and 14 respectively, are a pair of flaps designated generally by the numerals 6 and 7 which are used to form the hollow end walls of the carton, and, ultimately, the compartmented interior of the carton. Attached to panel 4 at each free side thereof are a pair of first outer side wall panels 8,9 separated therefrom by fold lines 15,16 respectively and the remaining flap structures designated generally by the numerals 22,23 for forming the hollow side walls of the carton. The flap structures 22,23 are substantially the same and include side wall top portions 24,25 foldably attached to wall panels 8,9 side wall inner portions 26,27 foldably attached to top portions 24,25, side wall filler tabs 28,29 foldably attached to the ends of side wall inner portion 26, side wall filler tabs 30,31 foldably attached to the ends of side wall inner portion 27 and side wall flap retaining extensions 32,33 foldably attached to the side wall inner portions 26,27. In addition, the flap structures 7,22 and 23 also include corner connecting flaps 17,18,19 and 20 located at the corners of bottom panel 4 and foldably attached to end and side walls 3,5 and 8,9.

Meanwhile, flap 7 located at what is nominally referred to as the front of the carton is divided by fold lines into an end wall top portion 34, and end wall inner portion 35 and a glue flap 36 to form a first hollow end wall for the carton. In a similar fashion, flap 6 is attached to the top cover panel 1 by a fold line 21 and it forms what is nominally referred to as the rear of the carton. Flap 6 is divided by suitable cut lines and scored fold lines to provide a second hollow end wall and the compartmented interior of the carton. In this regard, a first panel 40 forms the second end wall top portion, the discreet panel elements 41,42,43 and 44 form the second end wall inner portion and flap 45 is a glue flap. The discreet panel elements 41,42,43 and 44 are each defined by offset but equally spaced and parallel fold lines wholly located in flap 6 and extending between perpendicular cut lines 46,47 and 48. Thus, when flap 6 is folded over and glue flap 45 is adhered to bottom panel 4, the finished surface of the blank is turned up and when the carton is finally squared for use, the discreet panel elements 41,42,43 and 44 automatically produce the compartmented interior of the carton.

Figure 3:
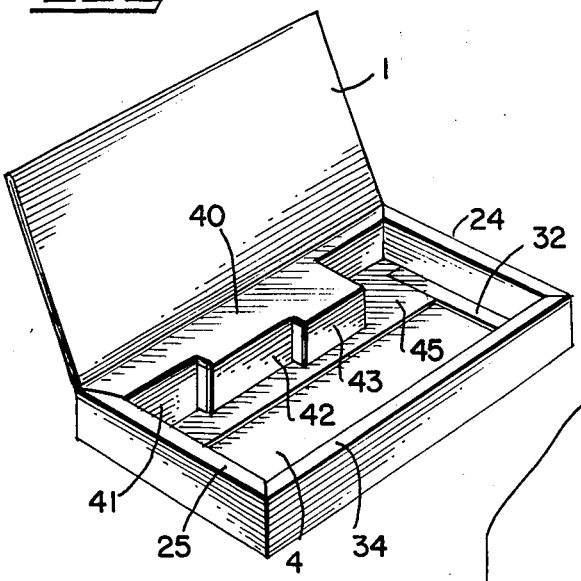
Figure 2:
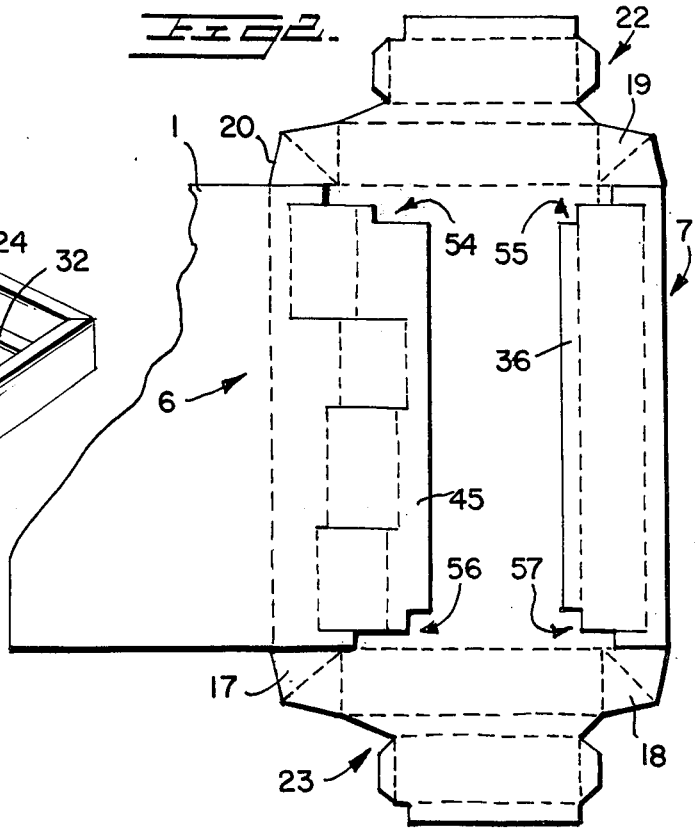
FIG. 2 shows the carton blank of FIG. 1 in its folded and glued condition ready for set-up in final carton form; and, FIG. 3 is a perspective view of the final carton prepared from the folded and glued blank in FIG. 2.

FIG. 2 illustrates the carton blank in its folded and glued condition for final assembly. However, prior to this step, the blank is first passed through a straight line glue applicator where adhesive is applied to the inside of the blank at 50 on glue flap 45, at one or more places 51,52 on top closure panel 1 and at 53 on glue flap 36. Subsequently, the blank is folded about score line 10 to adhere the two top closure panel 1,2 together and the glue flap 45 to the bottom panel 4. In addition, the blank is folded about score line 14 to adhere glue flap 36 to the bottom panel 4. At this point, the hollow side walls are erected substantially as shown in some of the prior art patents cited hereinbefore. For instance, with the hollow end walls squared, the corner connecting flaps 17,18,19 and 20 are tucked in, the side wall outer portions 8 and 9 are folded up, the side wall filler tabs are folded in and behind the end wall inner panels 35,41,44 and the side wall flap retaining extensions 31,32 are folded out and engaged within the slots 54,55 and 56,57 provided therefore adjacent the glue flaps 45 and 36. Upon completion of these folds, the carton is squared with the hollow walls locked in an upright position substantially as shown in FIG. 3.

It may thus be seen that the present invention provides an improved collapsible carton having fully finished interior and exterior surfaces that is formed from a blank that is finished only on one surface. Moreover, the carton includes an integral fully finished top closure and an unique compartemented interior. In addition, the carton is easy to manufacture, assemble and erect; it is economical of material used and labor to produce and assemble; and, it fully protects and partially isolates the enclosed articles from one another, all of which is a general improvement over the prior art.

Accordingly, this specification and the accompanying drawing describe and illustrate only a preferred embodiment of the carton according to the present invention including the steps necessary for fabricating the novel inner compartment structure of the carton. It is to be understood, however, that even though only a preferred embodiment has been described in detail, numerous changes and variations could be made in the construction of the carton while retaining the novelty of the invention. Thus, it will be understood by those skilled in the art that variations in the implementation of the concepts of the invention are within the scope of the invention as defined in the appended claims.

We claim:

1. An easily erectable display carton formed from a single blank of finished one side paperboard or the like and adapted to be folded and assembled into a completed carton construction having finished interior and exterior surfaces comprising, a bottom wall, a pair of upstanding hollow side walls integral with said bottom wall including outer, top and inner portions and a first upstanding hollow end wall integral with said bottom wall including outer, top and inner portions, the improvement comprising an integral carton top and second upstanding hollow end wall integral with said bottom wall, said integral carton top and second hollow end wall comprising an outer end wall portion foldably attached to said bottom wall, a double panel carton top wherein the first panel thereof is foldably attached to the outer end wall portion of said second hollow end wall and the second panel thereof is foldably attached to the first panel of said double panel carton top, an end wall top portion foldably attached to the second panel of said double panel carton top, said end wall top portion including a plurality of offset and parallel score lines which divide the top portion into segments of different widths, and an end wall inner portion foldably attached to the end wall top portion of said second hollow end wall, said end wall inner portion including a plurality of offset and parallel cut lines which are coterminous with the ends of the score lines in the end wall top portion of said second hollow end wall to divide said end wall inner portion into segments of different width corresponding to the different width segments of said end wall top portion, said hollow side and end walls each including retaining means integral with said side and end wall inner portions which frictionally engage one another to hold said hollow side and end walls in the completed construction which comprises an interior divided into a plurality of compartments having different widths between the upstanding hollow side walls and different lengths between the first and second upstanding hollow end walls.

* * * * *